US006188054B1

(12) United States Patent
Ohta

(10) Patent No.: US 6,188,054 B1
(45) **Date of Patent: *Feb. 13, 2001**

(54) INDUCTION HEATING APPARATUS FOR HEATING IMAGE ON RECORDING MATERIAL

(75) Inventor: Tomoichiro Ohta, Shimizu (JP)

(73) Assignee: Canon Kabushiki Kaisha, Tokyo (JP)

( * ) Notice: This patent issued on a continued prosecution application filed under 37 CFR 1.53(d), and is subject to the twenty year patent term provisions of 35 U.S.C. 154(a)(2).

Under 35 U.S.C. 154(b), the term of this patent shall be extended for 0 days.

(21) Appl. No.: 09/487,608

(22) Filed: Jan. 19, 2000

(30) Foreign Application Priority Data

Jan. 22, 1999 (JP) ..... 11-013931

(51) Int. Cl.[7] ..... H05B 6/08; H05B 6/10

(52) U.S. Cl. ..... 219/663; 219/667; 219/662; 219/619; 399/330; 399/336

(58) Field of Search ..... 219/619, 636, 219/645, 656, 661, 662, 663, 665, 664, 667; 399/320, 328, 330, 335, 336

(56) References Cited

U.S. PATENT DOCUMENTS

| | | | | |
|---|---|---|---|---|
| 3,962,992 | * | 6/1976 | Takgi et al. | 399/292 |
| 5,012,487 | * | 4/1991 | Simcock | 219/663 |
| 5,250,777 | * | 10/1993 | Fishman | 219/662 |
| 5,467,183 | * | 11/1995 | Snelling | 399/223 |
| 5,942,882 | | 8/1999 | Ohta | 323/282 |

* cited by examiner

*Primary Examiner*—Philip H. Leung
(74) *Attorney, Agent, or Firm*—Fitzpatrick, Cella, Harper & Scinto

(57) ABSTRACT

The present invention relates to an induction heating apparatus for heating an image on a recording material which has an electric conductor, a first coil, for inducing an eddy current in the electric conductor disposed over a longitudinal direction of the electric conductor, a second coil disposed so as to overlap an end portion of the first coil, a first power supply for supplying an alternating current to the first coil, a second power supply for supplying an alternating current to the second coil, a phase shifting circuit for controlling a phase of the alternating current supplied to the second coil, and control means for controlling the phase shifting circuit in conformity with a temperature of the electric conductor.

14 Claims, 7 Drawing Sheets

INDUCTION HEATING APPARATUS FOR HEATING IMAGE ON RECORDING MATERIAL

BACKGROUND OF THE INVENTION

1. Field of the Invention

This invention relates to an induction heating apparatus which is effective when used as a heating and fixing device in an image forming apparatus such as a copier or a printer.

2. Related Background Art

The present invention relates, for example, to an induction heating apparatus (a heating apparatus of an electromagnetic induction heating type) used as a fixing device or the like for heating and fixing a heat-meltable powder image (visualizing agent image) such as a toner image on paper in an image forming apparatus such as a copier.

Particularly, it relates to an induction heating apparatus for supplying electric power to a plane type heating coil (induction heating coil) and induction-heating an object to be heated.

It also relates to an image forming apparatus provided with the induction heating apparatus as image heating means.

There have been devised various methods of induction-heating a planar object and various heating coil shapes. Among these, a planar type heating coil shape exhibits relatively high heating efficiency because the area of the heating coil which faces a planar object to be heated can be secured widely.

FIGS. 6A, 6B, 7A and 7B of the accompanying drawings show an example of such an induction heating apparatus. This example of the apparatus is an image heating and fixing device of an induction heating type and a film heating type, and FIGS. 6A and 6B are a transverse side model view and a longitudinal front model view, respectively, of the essential portions of the apparatus, and FIG. 7A is a plan model view of a plane type and ellipse-like heating coil.

In FIGS. 6A, 6B, 7A and 7B, the reference numeral 11 designates an induction heat generating member comprising a magnetic member as an object to be heated (heater or heating member), and for example, a sideways long, flat, thin iron plate. The reference numeral 12 denotes a heat-resisting holding member fixedly holding the object 11 to be heated, the reference numeral 13 designates heat-resisting thin film (hereinafter referred to as the fixing film), and the reference numeral 14 denotes an elastic pressing roller.

The elastic pressing roller 14 is formed with a heating nip portion (fixing nip portion) N of a predetermined nip width and is brought into pressure contact with the underside of the object 11 to be heated fixedly held by the holding member 12 against the elasticity thereof with the fixing film 13 interposed therebetween.

The reference numeral 1 designates a plane type and ellipse-like heating coil fixedly held and disposed on the upper surface side of the object to be heated which is the opposite side to the fixing nip portion N side of the object 11 to be heated fixedly held by the holding member 12, in face-to-face relationship with the object 11 to be heated. The length and width of this plane type and ellipse-like heating coil 1 are substantially the same as the length and width of the object 11 to be heated.

A high frequency current (high frequency AC electric power or an induction current for heating) is supplied from an exciting circuit, not shown, to the heating coil 1, whereby an AC magnetic field (alternating magnetic flux) is produced, and the AC magnetic field acts on the object 11 to be heated which is an induction heat generating member comprising a magnetic member, whereby an induction current is induced in the object 11 to be heated, and the object 11 to be heated generates heat (Joule heat by eddy current loss) by induction heating and rises in temperature.

The temperature rise of the object 11 to be heated is detected by a temperature measuring element (temperature detecting element), not shown, and the supply of electric power from the exciting circuit to the heating coil 1 is controlled by a temperature control system, not shown, and the temperature control of the object 11 to be heated is done so that the measured temperature may be maintained at a predetermined fixing temperature.

The fixing film 13 is a cylindrically shaped or endless belt-shaped or rolled end-having web-shaped member, and is conveyed in the direction of arrow by driving means, not shown, or the rotatively driving force of the pressing roller 14 while sliding in close contact with the underside of the object 11 to be heated in the fixing nip portion N.

When in a state in which the object 11 to be heated has been induction-heated to a predetermined temperature and the fixing film 13 has been conveyed in the direction of arrow, a recording material P bearing an unfixed toner image t formed thereon is introduced into between the fixing film 13 and the pressing roller 14 in the fixing nip portion N, the recording material P is conveyed through the fixing nip portion N with the fixing film 13 while being in close contact with the surface of the fixing film 13.

In this fixing nip portion N, the recording material P and the toner image t thereon are heated by the object 11 to be heated through the fixing film 13 and the toner image t on the recording material P is fixed.

The recording material portion which has passed through the fixing nip portion N curvature-peels from the surface of the fixing film 13 and is conveyed.

As previously described, the shape of the plane type heating coil enables the area of the heating coil 1 which faces the plane-like object 11 to be heated to be secured widely and therefore exhibits relatively high heating efficiency, and by using the coil shape as described above, that portion of the object to be heated which corresponds to the lengthwisely central portion of the heating coil 1 becomes relatively uniform in heat generation distribution, but the longitudinally opposite end portions of the heating coil 1 do not become uniform in the distribution of a magnetic field and therefore, those portions of the object to be heated which correspond to the longitudinally opposite end portions of the heating coil 1, i.e., the longitudinally opposite end portions of the object to be heated, cause abnormal heat generation, and correspond to the opposite end portions of the heating portion and therefore, it has often been the case that as shown in FIG. 7B of the accompanying drawings, those portions become low temperature portions from which the heat escapes to the outside.

SUMMARY OF THE INVENTION

The present invention has been made in view of the above-noted problem, and an object thereof is to provide an induction heating apparatus which can uniformize the temperature of the whole of a heat generating portion.

Another object of the present invention is to provide an induction heating apparatus which can suppress the excessive temperature rise of the opposite portions of a heat generating portion.

Still another object of the present invention is to provide an induction heating apparatus comprising:

an electric conductor;

a first coil for inducing an eddy current in the electric conductor, the first coil being disposed over the longitudinal direction of the electric conductor;

a second coil disposed so as to overlap the end portion of the first coil;

a first power supply for supplying an alternating current to the first coil;

a second power supply for supplying an alternating current to the second coil;

a phase shifting circuit for controlling the phase of the alternating current supplied to the second coil; and control means for controlling the phase shifting circuit in conformity with the temperature of the electric conductor.

Further objects of the present invention will become apparent from the following detailed description taken in conjunction with the accompanying drawings.

DESCRIPTION OF THE PREFERRED EMBODIMENTS

Figure 1A:
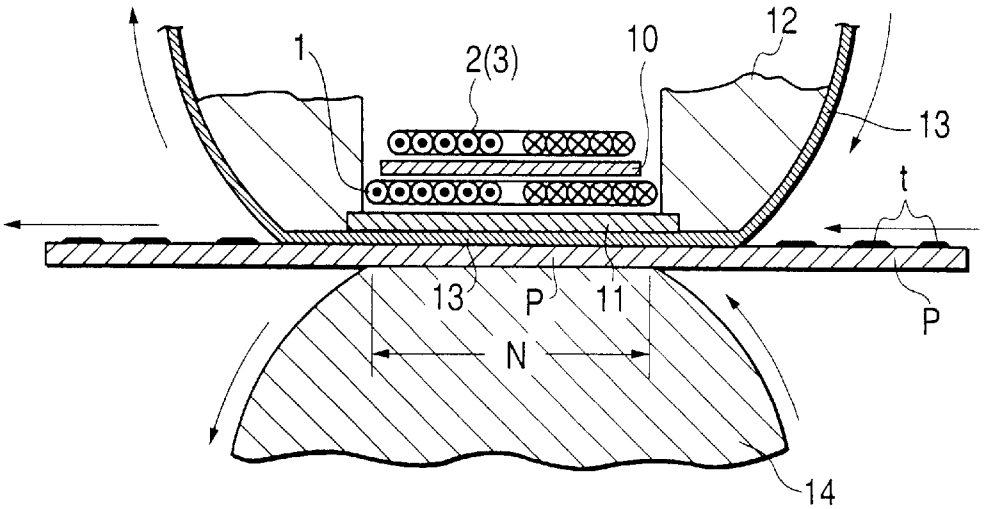
FIGS. 1A and 1B are a transverse side model view and a longitudinal front model view, respectively, of the essential portions of an induction heating apparatus (image heating and fixing device) according to an embodiment of the present invention.
Figure 1B:
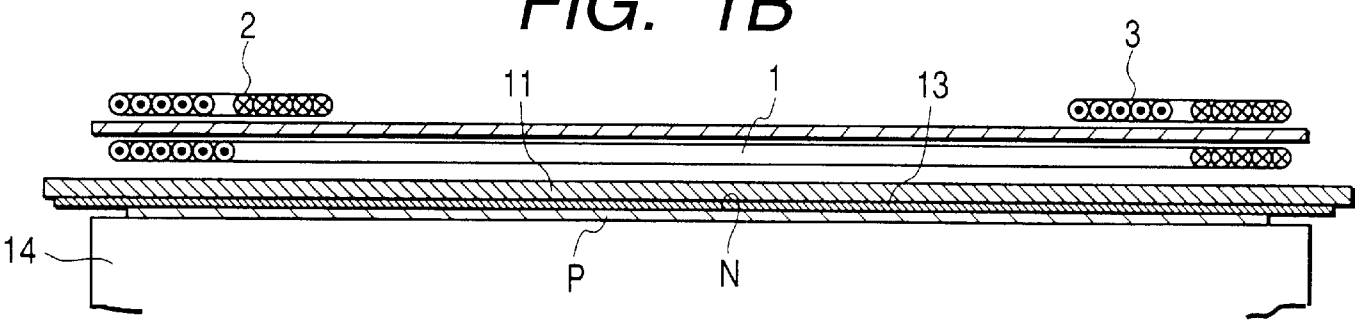
Figure 2A:
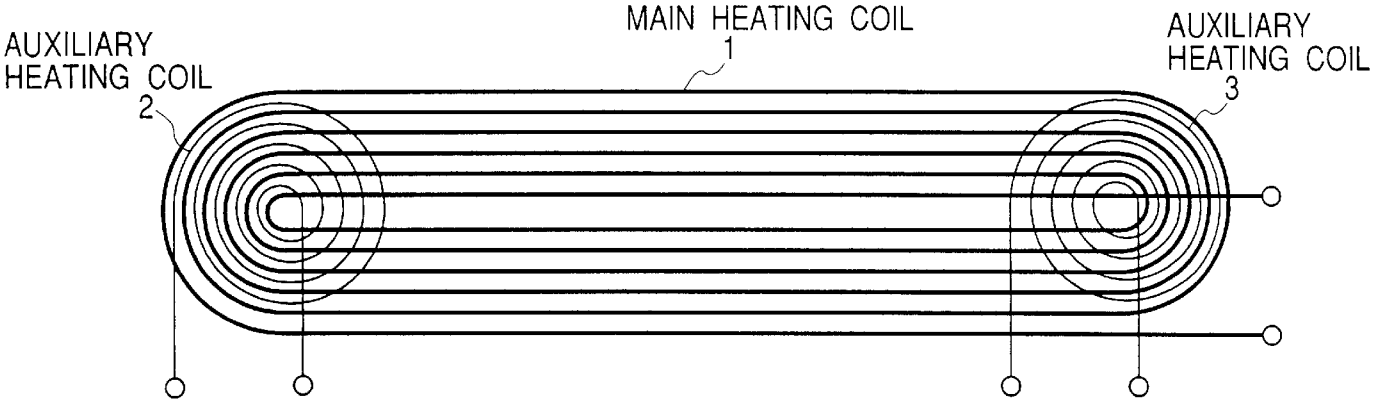
FIG. 2A is a plan model view of a plane type and ellipse-like heating coil.
Figure 2B:
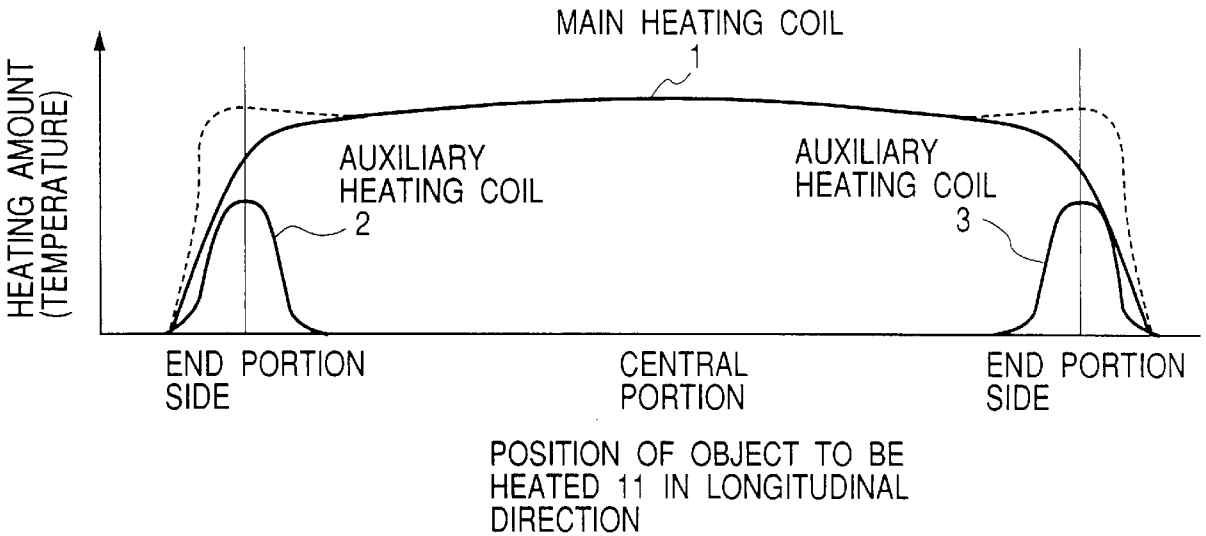
FIG. 2B is a graph of the heat (temperature) distribution of an object to be heated in the longitudinal direction thereof.
Figure 3:
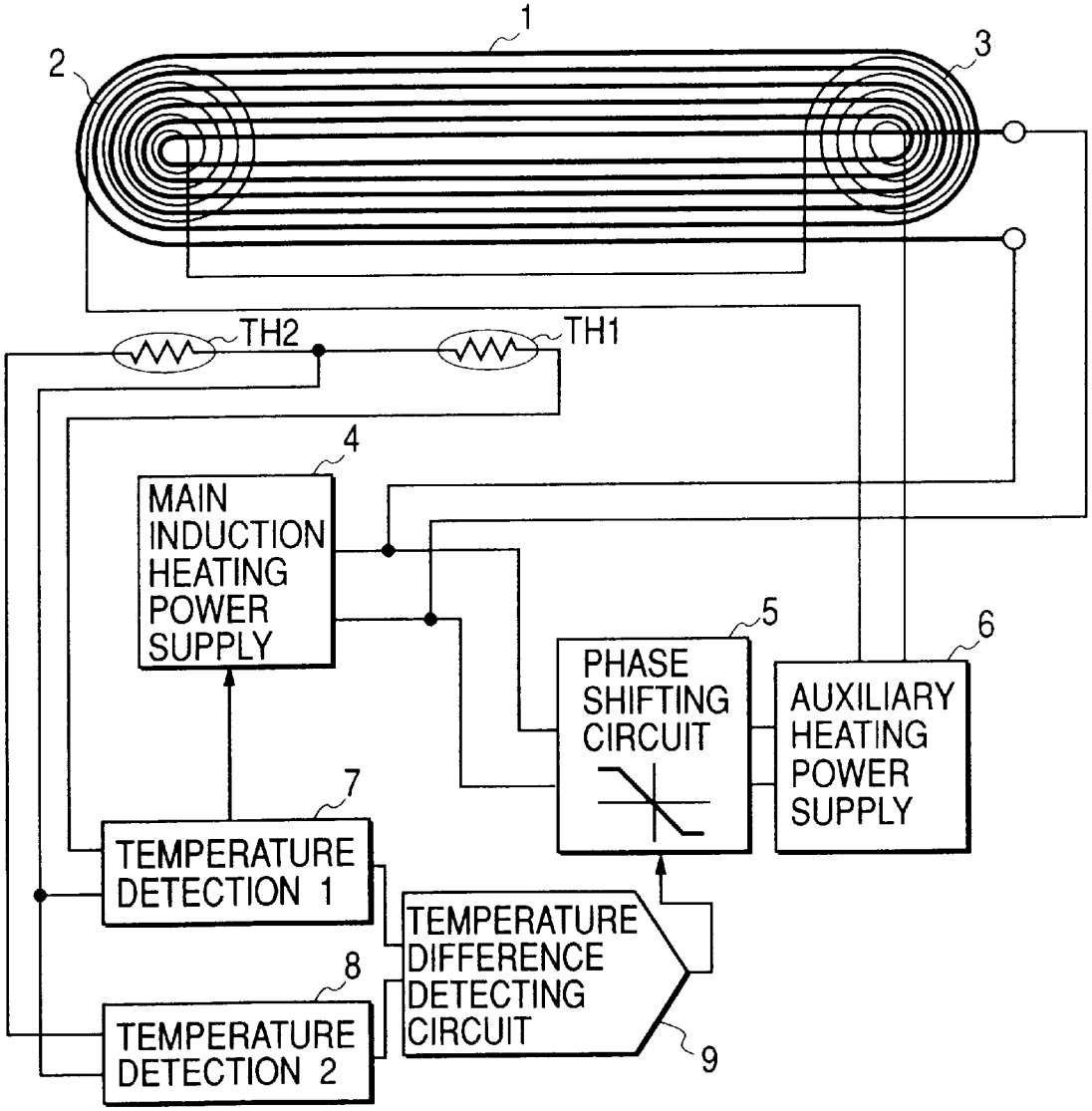
FIG. 3 is a block diagram of a control system.

FIGS. 1A, 1B, 2A, 2B and 3 show an embodiment of the induction heating apparatus according to the present invention. The apparatus according to the present embodiment is an image heating and fixing device of an induction heating type, and FIGS. 1A and 1B are a transverse side model view and a longitudinal front model view, respectively, of the essential portions of this apparatus, FIG. 2A is a plan model view of a plane type and ellipse-like heating coil, and FIG. 3 is a block diagram of a control system.

The constituent members and portions common to those of the aforedescribed image heating and fixing device of FIGS. 6A, 6B, 7A and 7B are given the same reference numerals and need not be described again.

(1) Construction of the Apparatus

When an ellipse-like heating coil 1 generally facing an object 11 to be heated comprising a planar magnetic member and inducing an induction current therein is a main heating coil (first coil), the reference numerals 2 and 3 designate auxiliary heating coils (second coils) disposed on the longitudinally opposite end portions of the main heating coil 1 for correcting the temperature distribution in the longitudinal direction of the object to be heated (electric conductor) 11 by the main heating coil 1.

The main heating coil 1 is of an elongated shape in order to efficiently heat the planar object 11 to be heated. The auxiliary heating coils 2 and 3 are disposed at locations overlapping the turn-back points of the winding points (the central portions of the opposite ends) of the longitudinally opposite end portions of the main heating coil 1. As shown in FIGS. 1A and 1B, the main heating coil 1 is disposed in face-to-face relationship with the object 11 to be heated comprising an iron plate or the like, and the auxiliary heating coils 2 and 3 are disposed in opposed relationship with the longitudinally opposite end portions of the main heating coil 1 with an insulating plate 10 interposed therebetween. This insulating plate 10 is added when the potential difference between the main heating coil 1 and the auxiliary heating coils 2, 3 is so great that voltage resistance is not kept by insulating covering alone. Although not clearly shown, the insulation by an insulator or the like required from safety standard is also provided between the main heating coil 1 and the object 11 to be heated.

(2) Construction of the Control System

In FIG. 3, the reference numeral 4 designates a main induction heating power supply (first power supply) for supplying heating electric power to the main heating coil 1, the reference numeral 5 denotes a phase shifting circuit for introducing the output voltage waveform of the main induction heating power supply 4 and changing the phase relative to the waveform in conformity with the outside control input and outputting it, and the reference numeral 6 designates an auxiliary heating power supply (second power supply) for amplifying the output waveform of the phase shifting circuit 5 and supplying electric power to the auxiliary heating coils 2 and 3.

TH1 denotes a first temperature measuring element (a temperature detecting element such as a thermistor), and the reference numeral 7 designates a first temperature detection circuit to which the temperature measurement output from the first temperature measuring element TH1 is inputted. The first temperature measuring element TH1 and the first temperature detection circuit 7 together constitute a central portion temperature measuring circuit for detecting the temperature of the center of the heating portion (the longitudinal center of the object 11 to be heated).

TH2 denotes a second temperature measuring element, and the reference numeral 8 designates a second temperature detection circuit to which the temperature measurement output from the second temperature measuring element TH2 is inputted. The second temperature measuring element TH2 and the second temperature detection circuit 8 together constitute an end portion temperature measuring circuit for detecting the temperature of the end portion of the heating portion (the longitudinal end portion of the object 11 to be heated).

The reference numeral 9 denotes a temperature difference detecting circuit for detecting the difference between the temperature of the central portion of the heating portion measured by the central portion temperature measuring circuit TH1·7 and the temperature of the end portion measured by the end portion temperature measuring circuit TH2·8 and producing the control voltage of the phase shifting circuit 5.

(3) Controlling Operation

A heating command signal is sent to the main induction heating power supply 4, whereby a high frequency AC power of the order of a frequency 20 KHz to 100 KHz is produced at the output terminal of this main induction heating power supply. This AC power is applied to the main heating coil 1, which thus produces an AC magnetic field. At this time, the AC power applied to the main heating coil 1 is changed by the object 11 to be heated, and usually is 200–300 W to several KW.

The AC magnetic field produced by the AC power applied to the main heating coil 1 produces an eddy current in the object 11 to be heated. By the eddy current, Joule heat is produced in the object to be heated, whereby the object to be heated itself generates heat.

By this electromagnetic inducing action, the object 11 to be heated generates heat and the temperature of the object to be heated rises.

Here, the temperature rise of the longitudinally central portion of the object 11 to be heated is monitored at any time by the central portion temperature measuring circuit TH1·7, and the temperature measurement output thereof is fed back to the main induction heating power supply 4.

The main induction heating power supply 4 operates to keep the temperature of the vicinity of the longitudinally central portion of the object to be heated constant by the use of such proportion control that compares a set target temperature and the inputted temperature measurement output (detected temperature) with each other and reduces the applied high frequency electric power when the temperature measurement output approximates to the set target temperature or a control method usually called PID control.

The temperature rise of the end portion of the object 11 to be heated is monitored at any time by the end portion temperature measuring circuit TH2·8, and the temperature measurement output thereof and the temperature measurement output of the central portion temperature measuring circuit TH1·7 are inputted to the temperature difference detecting circuit 9, whereby a control value conforming to the temperature difference between the central portion and the end portion of the object 11 to be heated is outputted from the temperature difference detecting circuit 9 and inputted to the phase shifting circuit 5.

The AC voltage waveform produced by the main induction heating power supply 4 and applied to the main heating coil 1 is inputted to the phase shifting circuit 5, and a voltage waveform proportional to the voltage waveform applied to the main heating coil is inputted to the auxiliary heating power supply 6 with its phase varied in conformity with the output of the temperature difference detecting circuit 9.

The auxiliary heating power supply 6 produces a high frequency electric power waveform proportional to the output voltage waveform of the phase shifting circuit 5 and applies it to the auxiliary heating coils 2 and 3 to thereby effect temperature correction as the whole of the heating coils 1, 2 and 3.

By adopting such a construction, as during the raising of heating, the generated heat of the opposite end portions is liable to escape as compared with that portion of the heating portion which corresponds to the longitudinally central portion of the main heating coil and therefore, as shown in the he at generating distribution of the main heating coil of FIG. 2B, the temperature rise of the opposite end portions is unavoidably delayed. A s compared with the central temperature detecting portion, the detected temperature by the end portion temperature measuring element is low and therefore, in the phase shifting circuit 5, the phase of the voltage waveform outputted to the auxiliary heating power supply 6 is advanced to thereby lead the phase shifting of the electric power waveform applied to the auxiliary heating coils 2 and 3. As the result, it becomes possible to increase the electric power applied to the both end portions with the heat generating distribution of the auxiliary heating coils 2 and 3 of FIG. 2B adjusted to the heat generating distribution of the main heating coil to thereby make up for the amount of heat escaping from the opposite end portions, and uniformly generate heat over the whole area of the heating coils 1, 2 and 3 indicated by broken line in FIG. 2B.

Also, as during steady heat generation, the heat is relatively liable to be taken in the central portion, whereas in the both end portions, the heat is difficult to take conversely to during raising and therefore, the temperature distribution is liable to become low in the central portion and high in the opposite end portions. At this time, the measured temperature by the end portion temperature measuring circuit TH2·8 is high relative to the measured temperature by the central portion temperature measuring circuit TH1·7. Therefore, the output of the phase shifting circuit 5 produces a waveform in which the phase shifting of the electric power waveform is delayed relative to the main induction heating power supply 4, and the auxiliary heating coils 2 and 3 absorb the generated electric power of the opposite end portions of the main heating coil and therefore, the applied electric power to the both end portions lowers relative to the central portion of the heating coil and the amount of generated heat also lowers and therefore, the heat generating distribution of the object 11 to be heated can be uniformized over the entire length of the main heating coil 1.

(4) Another Example of the Construction of the Control System

Figure 4:
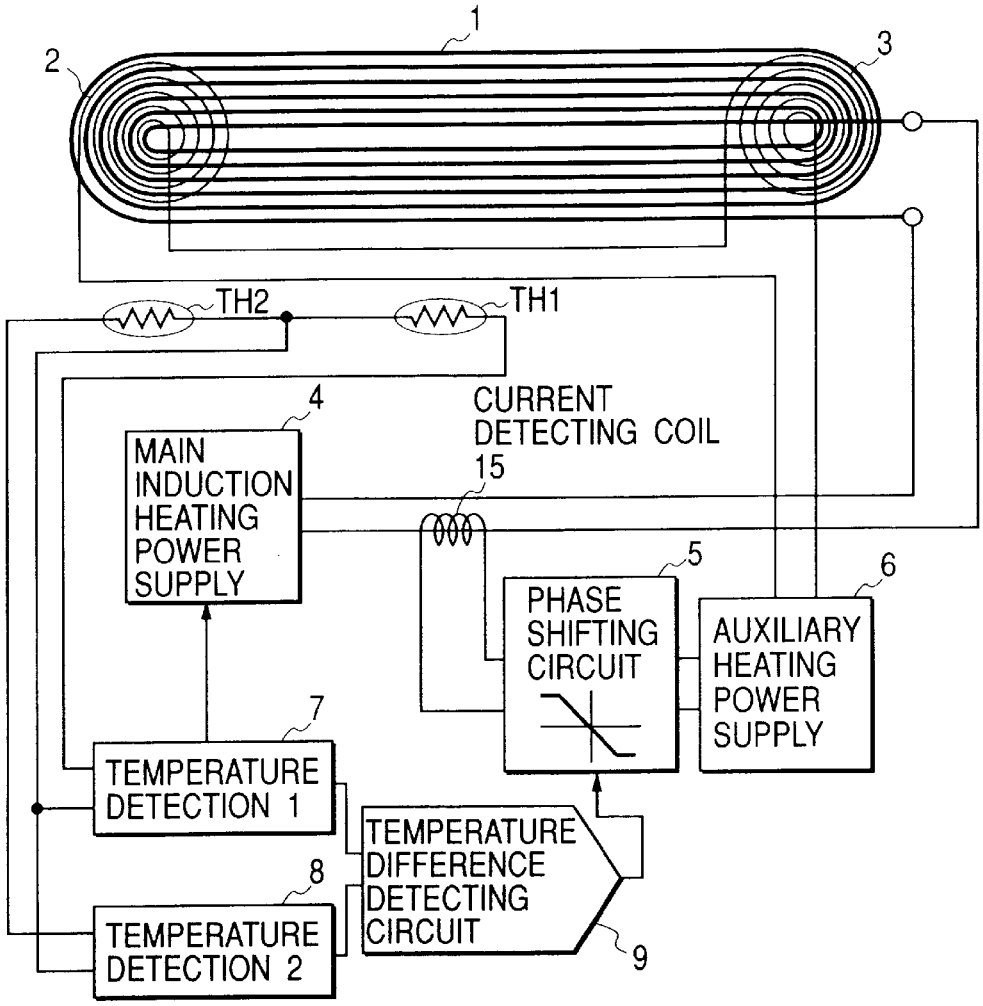
FIG. 4 is a block diagram of another control system.

FIG. 4 shows another embodiment of the control system. In this circuit, a high frequency current waveform flowing to the main heating coil 1 is used as the input standard signal of the phase shifting circuit 5 and therefore, a current detecting coil 15 is added. In the other points, the circuit construction of this control system is similar to the circuit construction of the control system of FIG. 3.

As described above, the current waveform flowing to the main heating coil 1 is used as the standard signal of the phase shifting circuit 5, whereby the main heating coil current waveform proportional to the output electric power o f the main induction heating power supply 4 becomes the standard signal of the phase shifting circuit 5, and a standard signal of an amplitude proportional to the applied electric power to the main heating coil 1 is inputted to the phase shifting circuit 5.

Since by this construction, the amplitude of the output voltage waveform of the phase shifting circuit 5 is proportional to the electric power of the main heating coil, the control for making the electric power of the auxiliary heating coil s 2 an d 3 to which the output of the auxiliary heating power supply 6 is inputted proportional to the electric power of the main heating coil can be accomplished.

Therefore, it can be simply realized to make the control of the auxiliary heating coil system follow the control of the electric power of the main heating coil system and thus, the stability of temperature can be improved.

Figure 8A:
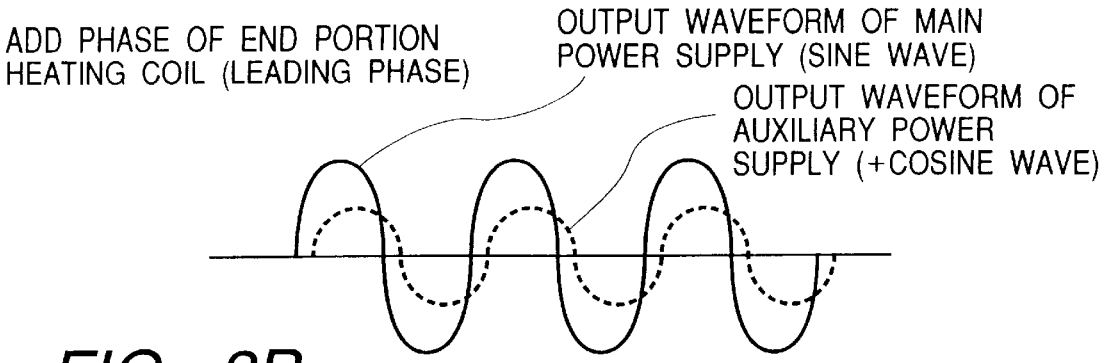
FIGS. 8A and 8B show a method of varying the phase of the output waveform of an auxiliary heating power supply to the output waveform of a main heating power supply to thereby adjust the heating amount of the end portion of an electric conductor.
Figure 8B:
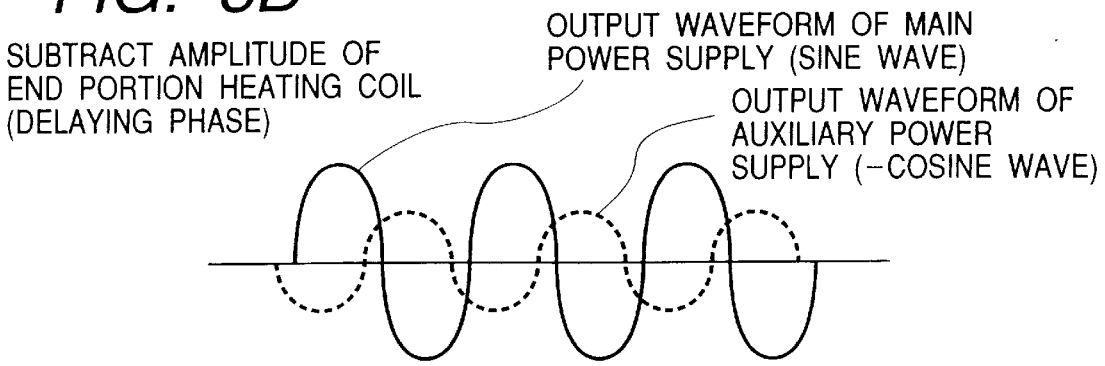

FIGS. 8A and 8B show the output waveforms outputted from the main heating power supply (first power source) and the auxiliary heating power supply.

FIGS. 8A and 8B are illustrations of a method of correcting the heat generating amount of the end portion heating coil by a variation in phase. FIG. 8A shows an example in which such output electric power that the generation phase angle of the electric power of the cosine output waveform of the end portion heating power supply is advanced relative to the sine waveform of the output electric power of the main heating power supply, whereby the heat generating amounts are superposed one upon the other is produced in the end portion heating coil when the temperature of the end portions of the roller falls as during raising or during the supply of a large-sized sheet, thereby increasing the heat generating amounts of the end portions of the roller. FIG. 8B shows an illustration of an example in which such output electric power of the opposite direction that during the temperature rise of the end portions of the roller such as during the supply of a small-sized sheet, the phase of the cosine waveform of the output of the end portion heating power supply is delay ed relative to the sine waveform of the output of the main heating power supply to thereby decrease the heat generating amount is produced to thereby effectively decrease the heat generating amounts of the end portions of the roller.

Figure 9A:
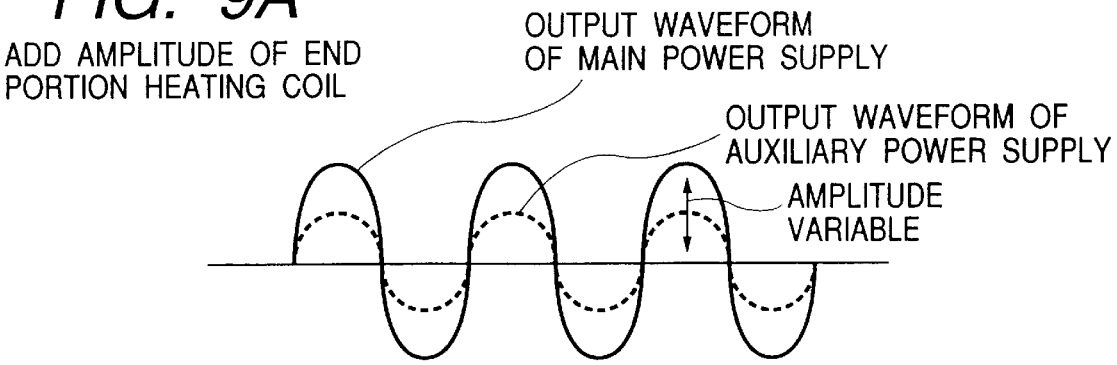
FIGS. 9A and 9B show a method of varying the amplitude of the output waveform of the auxiliary heating power supply to thereby adjust the heating amount of the end portion of the electric conductor.
Figure 9B:
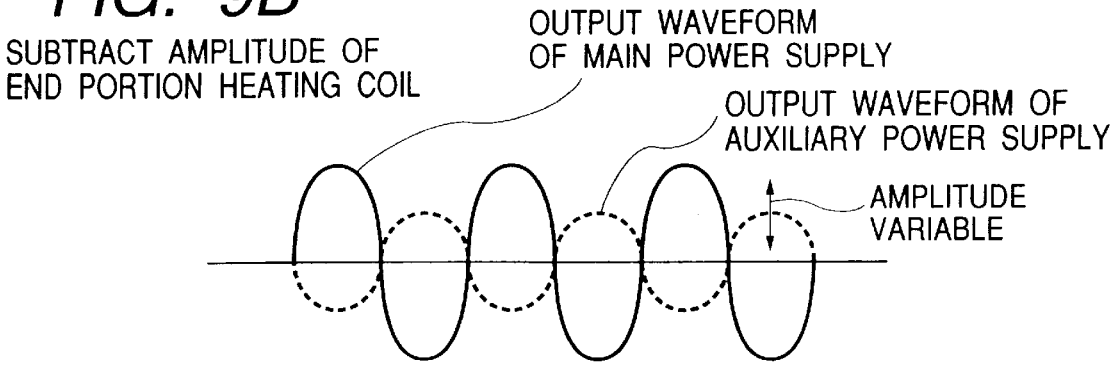

FIGS. 9A and 9B show another method of increasing or decreasing the heat generating amounts of the end portions.

FIGS. 9A and 9B are illustrations of a method of correcting the heat generating amount of the end portion heating coil by a variation in amplitude. FIG. 9A shows an example in which output electric power is produced in the end portion heating coil when the temperature of the end portions of the roller falls as during raising or during the supply of a large-sized sheet so that the output waveform of the end portion heating power supply may be superposed on the output waveform of the main heating power supply, thereby increasing the heat generating amounts of the end portions of the roller. FIG. 9B is an illustration of an example in which during the temperature rise of the end portions of the roller such as during the supply of a small-sized sheet, output electric power is produced such that the output waveform of the end portion heating power supply is opposite in direction to the output waveform of the main heating power supply to thereby effectively decrease the heat generating amounts of the end portions of the roller.

When as shown in FIGS. 8A and 8B, instead of the amount of phase deviation of the output waveform of the auxiliary power supply relative to the output waveform of the main power supply being varied to thereby adjust the temperature of the end portions, the temperature of the end portions is to be raised, the amplitude of the output waveform of the auxiliary power supply is varied with the phases of the output waveform of the main power supply and the output waveform of the auxiliary power supply brought into accord with each other as shown in FIG. 9A, thereby adjusting the heat generating amounts of the end portions. When conversely, the temperature of the end portions is to be lowered, as shown in FIG. 9B, the output waveform of the auxiliary power supply is deviated by 180° relative to the output waveform of the main power supply by a phase reversing circuit, and the amplitude thereof is varied to thereby adjust the heat generating amounts of the end portions.

(5) Example of the Image Forming Apparatus

Figure 5:
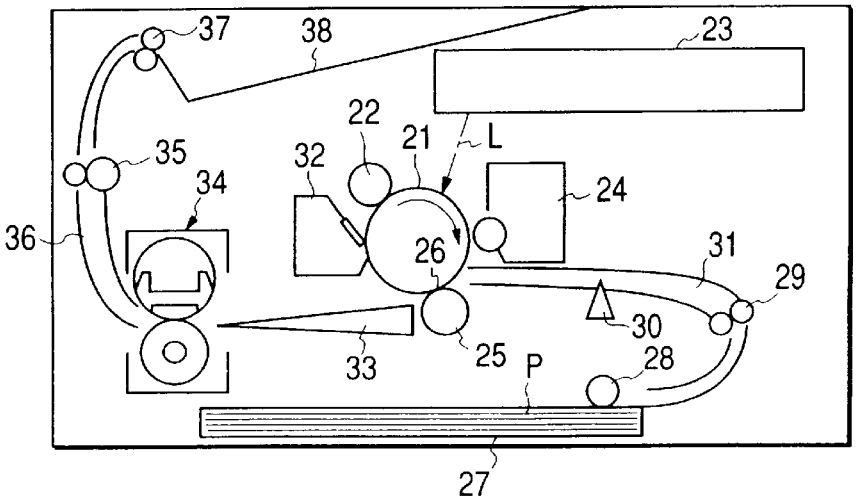
FIG. 5 schematically shows the construction of an image forming apparatus.
Figure 6A:
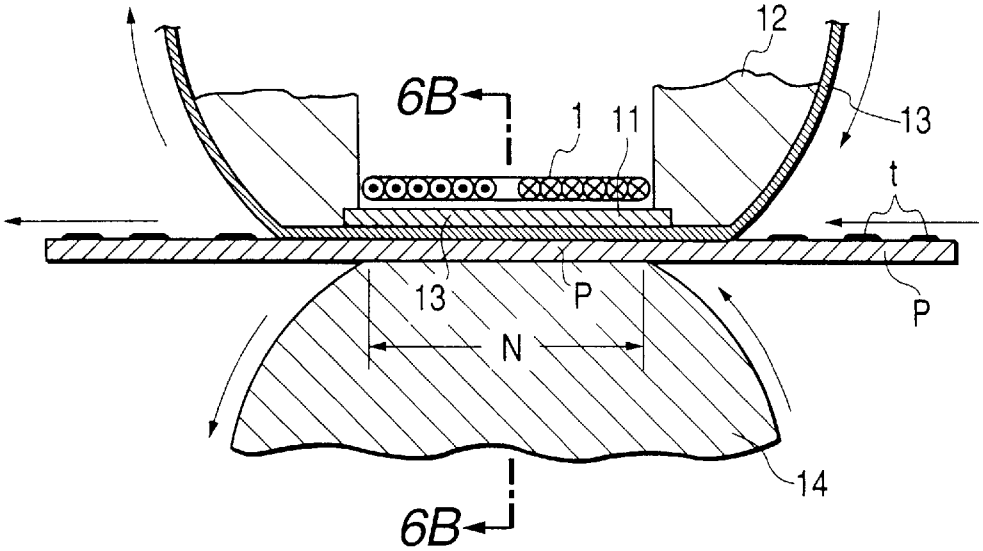
FIGS. 6A and 6B are a transverse side model view and a longitudinal front model view, respectively, of an induction heating apparatus (image heating and fixing device) according to the prior art.
Figure 6B:
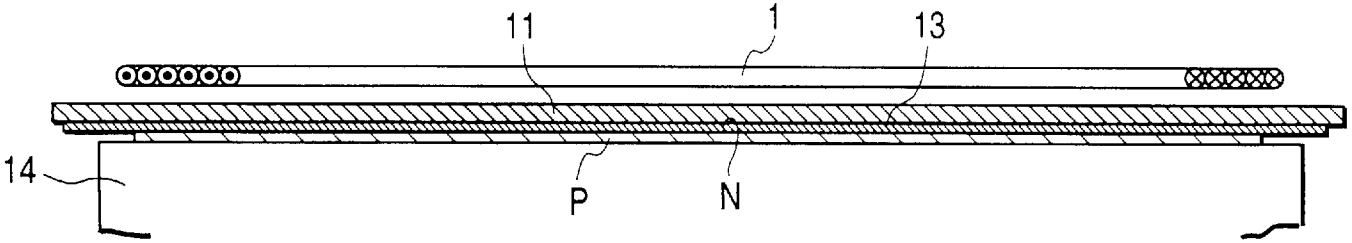
Figure 7A:
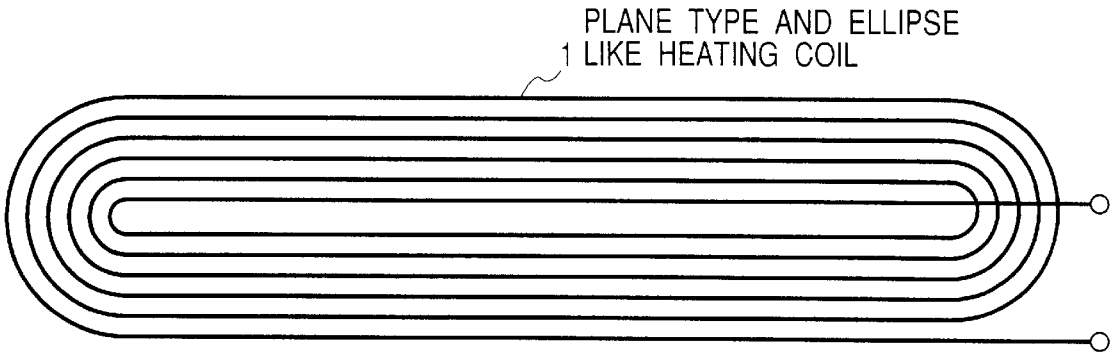
FIG. 7A is a plan model view of a plane type and ellipse-like heating coil.
Figure 7B:
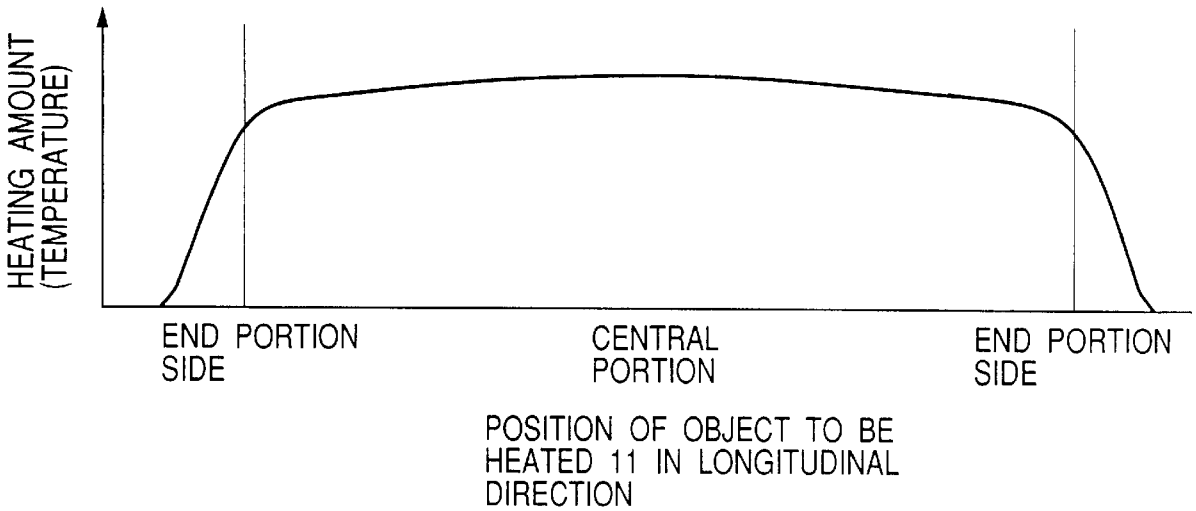
FIG. 7B is a graph of the heat (temperature) distribution of an object to be heated in the longitudinal direction thereof.

FIG. 5 schematically shows the construction of an example of an image forming apparatus provided with the above-described induction heating apparatus as an image heating and fixing device. This example of the image forming apparatus is a laser beam printer utilizing the transfer type electrophotographic process.

The reference numeral 21 designates a rotary drum type electrophotographic photosensitive member (hereinafter referred to as the photosensitive drum) as an image bearing member, which is rotatively driven in the clockwise direction of arrow at a predetermined peripheral speed (process speed).

The photosensitive drum 21, in its rotating process, is uniformly charged to a predetermined polarity and potential by a charging roller 22 as a charging device.

The photosensitive drum 21 is then subjected to laser beam scanning exposure L corresponding to a desired image information pattern by a laser optical system (laser scanner) 23 as an exposing device. Thereby, an electrostatic latent image corresponding to the desired image information pattern is formed on the surface of the photosensitive drum 21.

The electrostatic latent image formed on the surface of the photosensitive drum 21 is toner-developed and visualized by a developing device 24. As the developing method, use is made of a jumping developing method, a two-component developing method or the like, and a combination of image exposure and reverse developing is often used.

The toner image formed on the surface of the photosensitive drum 21 is sequentially transferred to a recording material (transfer material) P fed from a sheet feeding portion 27 to a transfer nip portion 26 formed by the photosensitive drum 21 and a transfer roller 25 in the transfer nip portion 26 at predetermined control timing. The toner image on the photosensitive drum 21 is sequentially transferred onto the paper P by a voltage of the opposite polarity to the charging polarity of the toner being applied to the transfer roller 25.

In the image forming apparatus of this example, the sheet feeding portion 27 is a cassette sheet feeding portion, and recording materials P stacked and contained in the sheet feeding cassette are separated and fed one by one by a sheet feeding roller 28 and a sheet separating member, not shown, and are fed to the transfer nip portion 26 through a pair of conveying rollers 29 and a sheet path 31 including a top sensor 30 at predetermined control timing.

The recording material P fed from the cassette sheet feeding portion 27 to the transfer nip portion 26 through the sheet path 31 has its leading end recognized by the top sensor 30 provided in the sheet path 31, and in synchronism therewith, an image is formed on the photosensitive drum 21.

The recording material P to which the toner image has been transferred in the transfer nip portion 26 is sequentially separated from the surface of the photosensitive drum 21 and is conveyed to a fixing device 34 through a guide 33, and the toner image thereon is subjected to the heating and fixing process by the fixing device 34. The fixing device 34 is a heating device of the above-described induction heating type and film heating type.

The recording material P on which the image has been fixed and which has left the fixing device 34 passes through a sheet path 36 including a pair of conveying rollers 35 and is discharged to a discharge tray portion 38 by a pair of discharge rollers 37.

On the other hand, contaminating adhering substances such as residual toner after transfer (untransferred toner) residual on the photosensitive drum 21 after the transfer of the toner image to the recording material P (after the separation of the paper) and paper powder are removed from the surface of the photosensitive drum 21 by a cleaner 32, and the surface-cleaned photosensitive drum 21 is repetitively used for image formation.

The induction heating apparatus of the present invention is not restricted to the image heating and fixing device according to the embodiment, but can be widely used as image heating devices such as a heating device for heating a recording material heating an image thereon and improving a surface property such as luster (gloss), and a heating device for tentatively fixing an image, and other means and devices for heating and processing materials to be heated such as a heating and drying device for materials to be heated and a heating laminate device.

Regarding the image forming apparatus, the principle and process of forming a visualizing agent image on the recording material are arbitrary.

As described above, according to the present invention, with respect to an induction heating apparatus for supplying electric power to a plane type heating coil to induction-heat an object to be heated, auxiliary heating coils are disposed on the longitudinally opposite end portions of the heating coil (the longitudinally opposite end portions of the main heating coil) corresponding to the longitudinally opposite end portions of an object to be heated in which the temperature distribution (heat generating distribution) is liable to become non-uniform, and use is made of an AC power supply for adding or subtracting a produced magnetic field from the auxiliary heating coils to the object to be heated in conformity with AC power applied to the main heating coil, whereby the heat generating state of those portions of the object to be heated which correspond to the longitudinally central portion and opposite end portions of the main coil can be independently controlled and the uniformity of temperature (the uniformity of heat generating distribution) in the longitudinal direction of the object to be heated which is a heat generating portion can be greatly improved.

The present invention is not restricted to the above-described embodiment, but covers all modifications within the technical idea of the invention.

What is claimed is:

1. An induction heating apparatus for heating an image on a recording material, comprising:

an electric conductor;

a first coil for inducing an eddy current in said electric conductor, said first coil being disposed over a longitudinal direction of said electric conductor;

a second coil disposed so as to overlap an end portion of said first coil;

a first power supply for supplying an alternating current to said first coil;

a second power supply for supplying an alternating current to said second coil;

a phase shifting circuit for controlling a phase of the alternating current supplied to said second coil; and control means for controlling said phase shifting circuit in conformity with a temperature of said electric conductor.

2. An induction heating apparatus according to claim 1, wherein said second coil, said second power supply and said phase shifting circuit have functions of increasing and decreasing the eddy current induced in said electric conductor.

3. An induction heating apparatus according to claim 1, further comprising a first temperature detecting element for detecting the temperature of a portion of said electric conductor which is opposed to an area in which said first coil and said second coil do not overlap each other, and a second temperature detecting element for detecting the temperature of a portion of said electric conductor which is opposed to an area in which said first coil and said second coil overlap each other, and wherein said control means controls said phase shifting circuit in conformity with the temperatures detected by said first and second temperature detecting elements.

4. An induction heating apparatus according to claim 1, wherein said phase shifting circuit further samples a voltage waveform of the alternating current supplied to said first coil.

5. An induction heating apparatus according to claim 1, wherein said phase shifting circuit further samples a current waveform of the alternating current supplied to said first coil.

6. An induction heating apparatus according to claim 1, further comprising a rotary member movable with the recording material, said electric conductor being provided on said rotary member.

7. An induction heating apparatus for heating an image on a recording material, comprising:

an electric conductor;

a first coil for inducing an eddy current in said electric conductor;

a second coil disposed so as to overlap said first coil;

a first power supply for supplying an alternating current to said first coil;

a second power supply for supplying an alternating current to said second coil;

a phase shifting circuit for controlling a phase of the alternating current supplied to said second coil.

8. An induction heating apparatus according to claim 7, said second coil disposed so as to overlap an end portion of said first coil.

9. An induction heating apparatus according to claim 7, further comprising a control means for controlling said phase shifting circuit in accordance with a size of the recording material.

10. An induction heating apparatus according to claim 9, further comprising a temperature detecting element for detecting a temperature of said electric conductor, and said first power supply supplies an alternating current to said first coil so that a temperature detected by said temperature detecting element is maintained at a target temperature.

11. An inducting heating apparatus according to claim 7, wherein said second coil, said second power supply and said phase shifting circuit have functions of increasing and decreasing the eddy current induced in said electric conductor.

12. An inducting heating apparatus according to claim 7, wherein said phase shifting circuit further samples a voltage waveform of the alternating current supplied to said first coil.

13. An induction heating apparatus according to claim 7, wherein said phase shifting circuit further samples a current waveform of the alternating current supplied to said first coil.

14. An induction heating apparatus according to claim 7, further comprising a rotary member movable with the recording material, said electric conductor being provided on said rotary member.

* * * * *

UNITED STATES PATENT AND TRADEMARK OFFICE

CERTIFICATE OF CORRECTION

PATENT NO. : 6,188,054 B1
DATED : February 13, 2001
INVENTOR(S) : Tomoichiro Ohta It is certified that error appears in the above-identified patent and that said Letters Patent is hereby corrected as shown below:

Column 6,
Line 48, "o f" should read -- of --.
Line 58, "coil s" should read -- coils --.

Signed and Sealed this

Thirteenth Day of November, 2001

*Attest:*

Nicholas P. Godici

*Attesting Officer*

NICHOLAS P. GODICI
*Acting Director of the United States Patent and Trademark Office*